US009816151B2

(12) United States Patent
Ichikawa et al.

(10) Patent No.: US 9,816,151 B2
(45) Date of Patent: Nov. 14, 2017

(54) METHOD FOR OPERATING BLAST FURNACE AND METHOD FOR PRODUCING MOLTEN PIG IRON

(71) Applicant: NIPPON STEEL & SUMIKIN ENGINEERING CO., LTD., Tokyo (JP)

(72) Inventors: Hiroshi Ichikawa, Tokyo (JP); Yasuyuki Oosawa, Tokyo (JP); Takafumi Hayashi, Tokyo (JP); Shin Tomisaki, Tokyo (JP)

(73) Assignee: NIPPON STEEL & SUMIKIN ENGINEERING CO., LTD., Tokyo (JP)

( * ) Notice: Subject to any disclaimer, the term of this patent is extended or adjusted under 35 U.S.C. 154(b) by 204 days.

(21) Appl. No.: 14/439,622

(22) PCT Filed: Dec. 4, 2013

(86) PCT No.: PCT/JP2013/082589

§ 371 (c)(1),
(2) Date: Apr. 29, 2015

(87) PCT Pub. No.: WO2014/088031

PCT Pub. Date: Jun. 12, 2014

(65) Prior Publication Data

US 2015/0275321 A1 Oct. 1, 2015

(30) Foreign Application Priority Data

Dec. 7, 2012 (JP) ..... P2012-268588
Oct. 11, 2013 (JP) ..... P2013-214049

(51) Int. Cl.

| | |
|---|---|
| ***C21B 5/00*** | (2006.01) |
| ***C21B 7/24*** | (2006.01) |
| *C21B 13/14* | (2006.01) |

(52) U.S. Cl.
CPC ..... *C21B 5/006* (2013.01); *C21B 5/003* (2013.01); *C21B 5/008* (2013.01); *C21B 7/24* (2013.01); *C21B 13/14* (2013.01); *C21B 2300/04* (2013.01)

(58) Field of Classification Search
CPC ..... C21B 5/006; C21B 5/003; C21B 5/008; C21B 7/24; C21B 2300/04
See application file for complete search history.

(56) References Cited

U.S. PATENT DOCUMENTS 3,460,934 A 8/1969 Kelmar
4,158,562 A * 6/1979 Mattioli ..... C21B 7/24 266/159

(Continued)

FOREIGN PATENT DOCUMENTS

CN 87105969 7/1988
CN 101528952 9/2009

(Continued)

OTHER PUBLICATIONS

CN 102010919 A published Apr. 2011. Machine translation of the patent.*

(Continued)

*Primary Examiner* — George Wyszomierski
*Assistant Examiner* — Tima M McGuthry Banks
(74) *Attorney, Agent, or Firm* — Procopio, Cory, Hargreaves & Savitch LLP

(57) ABSTRACT

Provided is a blast-furnace operating method including: a first step of adjusting a charging rate of coke while monitoring a furnace-top temperature $T_{top}$; a second step of adjusting an injection rate of pulverized coal while monitoring an in-furnace superficial gas velocity u and the furnace-top temperature $T_{top}$; a third step of adjusting an oxygen-enrichment ratio of oxygen-enriched air while (Continued)

monitoring a tuyere combustion temperature $T_f$ and the furnace-top temperature $T_{top}$; and a fourth step of determining whether an injection rate of the oxygen-enriched air needs to be adjusted, based on a value of the in-furnace superficial gas velocity u.

17 Claims, 5 Drawing Sheets

(56) References Cited

U.S. PATENT DOCUMENTS

| | | | | | |
|---|---|---|---|---|---|
| 4,248,624 | A * | 2/1981 | Novoa | C21B 5/008 75/472 |
| 4,421,553 | A * | 12/1983 | Ponghis | C21B 5/006 75/10.38 |
| 4,695,315 | A * | 9/1987 | Kortmann | C21B 5/008 75/311 |
| 4,921,532 | A * | 5/1990 | Corbett | C21B 5/003 266/182 |
| 2006/0108721 | A1* | 5/2006 | Weaver | C21B 7/14 266/90 |
| 2010/0068088 | A1 | 3/2010 | Tanaka et al. | |
| 2011/0023657 | A1 | 2/2011 | Ibaraki et al. | |

FOREIGN PATENT DOCUMENTS

| | | | | |
|---|---|---|---|---|
| CN | 101790590 | | | 7/2010 |
| CN | 102010919 | A | * | 4/2011 |
| JP | 09-013109 | A | * | 1/1997 |
| JP | 9-013109 | A | | 1/1997 |
| JP | 09078111 | A | * | 3/1997 |
| JP | 11-286705 | A | | 10/1999 |
| JP | 2001-073016 | A | | 3/2001 |
| JP | 2001-131616 | A | | 5/2001 |
| JP | 2001-234213 | A | | 8/2001 |
| JP | 2003-247008 | A | | 9/2003 |
| JP | 2004-027265 | A | | 1/2004 |
| JP | 2008-111172 | A | | 5/2008 |
| JP | 2009-102746 | A | | 5/2009 |
| JP | 2012-007204 | | | 1/2012 |
| KR | 10-2003-095076 | A | * | 10/2003 |
| RU | 2171848 | | | 8/2001 |
| WO | 2008-059739 | A | | 5/2008 |

OTHER PUBLICATIONS

JP 09013109 published Jan. 1997. Machine translation of the patent.*

JP 09078111 published Mar. 1997. Machine translation of the patent.*

Choi et al. KR 10-2003-095076 A published Oct. 2003. Machine translation.*

First Office Action and Search Reporting for CN App No. 201380059105.8 dated Feb. 22, 2016, 7 pgs.

Office Action for RU Patent App No. 2015127097 dated Sep. 28, 2016, 10 pgs.

International Preliminary Report on Patentability dated Jun. 18, 2015, issued for International Application No. PCT/JP2013/082589.

International Search Report dated Mar. 11, 2014, issued for International Application No. PCT/JP2013/082589.

Yutaka Ujisawa et al., "Effect of HBI Utilization on Blast Furnace Productivity", Journal of the Iron & Steel Institute of Japan, Oct. 1, 2006, pp. 591-600.

Kouro nai genshou to sono kaiseki ("Phenomenon in the Blast Furnace and Analysis Thereof"), published in 1982, p. 67.

"The Iron and Steel Institute of Japan", reference text, published in 1982, p. 42.

Extended European Search Report for EP App No. 13860106.7 dated Dec. 3, 2015, 7 pgs.

* cited by examiner

METHOD FOR OPERATING BLAST FURNACE AND METHOD FOR PRODUCING MOLTEN PIG IRON

The present application is a National Stage entry of PCT/JP2013/082589, filed on Dec. 4, 2013, and claims priority to Japanese Patent Application Nos. P2012-268588, filed on Dec. 7, 2012, and P2013-214049, filed on Oct. 11, 2013.

TECHNICAL FIELD

The present invention relates to a blast-furnace operating method and a molten-pig-iron production method.

BACKGROUND ART

In a blast furnace, iron-oxide raw material such as iron ore is reduced with coke, for example, to produce molten pig iron. Generally, in operating a blast furnace, from viewpoints of safe operation and facility-related constraints, the temperature at a furnace top and the temperature near a tuyere of the blast furnace need to be controlled within a predetermined temperature range. Conventionally, from a viewpoint of resource conservation, for example, a technique of injecting pulverized coal into a blast furnace has been proposed to decrease the amount of coke used.

For example, Patent Literature 1, focusing on the combustion temperature in raceways of tuyere ends, proposes decreasing the coke ratio by charging metallic iron such as scrap iron or reduced iron into a blast furnace in the operation in which pulverized coal is injected at a constant rate. When molten pig iron is produced by using a blast furnace, the production amount of the molten pig iron per unit capacity of the blast furnace is required to be increased by sufficiently utilizing the capability of the blast furnace. As an index indicating such a production amount of molten pig iron, a productivity is used. Patent Literature 1 describes that a productivity of 2.19 to 2.40 t/(d·m) can be achieved.

CITATION LIST

Patent Literature

[Patent Literature 1] Japanese Patent Application Laid-Open Publication No. 2001-234213

SUMMARY OF INVENTION

Technical Problem

Because higher efficiency is required in operation of a blast furnace, production rate is required to be enhanced by achieving a higher productivity than ever before. There are two methods to increase the productivity. In one method thereof, increasing the injection flow rate of oxygen-enriched air injected into the blast furnace is effective. However, the increase of the injection flow rate of air and oxygen, for example, increases the flow velocity of gas rising in the furnace. Consequently, it is concerned that scaffolding, flooding, and fluidization are more likely to occur in the blast furnace, hindering the stable operation of the blast furnace. Thus, the increase of the injection flow rate of air is limited. The other method is a method of increasing the concentration of oxygen contained in the oxygen-enriched air. Difference between the oxygen concentration in the oxygen-enriched air and the oxygen concentration in the atmosphere is called an oxygen-enrichment ratio. Increasing of the oxygen-enrichment ratio can increase the amount of oxygen injected into the furnace without increasing the injection flow rate of the oxygen-enriched air. As a result, the productivity can be increased with the stability of the blast furnace operation being maintained.

If the oxygen-enrichment ratio of the oxygen-enriched air becomes excessively high, the amount of inert gas such as nitrogen contained in the oxygen-enriched air relatively decreases, which decreases sensible heat transported by the inert gas. Consequently, the temperature in the blast furnace decreases. When the temperature in the furnace decreases, it is concerned that insufficient reduction of iron-oxide raw material such as iron ore occurs, thereby deteriorating the stable operation of the blast furnace. At the same time, the temperature at the furnace top of the blast furnace decreases. When the furnace-top temperature decreases, it is concerned that metal such as zinc is deposited at the top of the blast furnace, whereby the stable operation of the blast furnace is hindered.

Furthermore, in the operation of the blast furnace, operating costs and greenhouse gas emissions are required to be reduced by decreasing the amount of coke used. The coke acts as a reducing agent for the iron-oxide raw material in the blast furnace and also reacts with oxygen in the air to generate heat needed for the reduction reaction. The pulverized coal injected from a tuyere substitutes for the coke thus acting. Accordingly, increasing the injection rate of pulverized coal can decrease the amount of coke used.

The present invention has been made in view of the above circumstances, and aims to provide a blast-furnace operating method that makes it possible to sufficiently increase the productivity while maintaining the stable operation of a blast furnace. The present invention also aims to provide a molten-pig-iron production method that making it possible to sufficiently increase the productivity while maintaining the stable operation of the blast furnace.

Solution to Problem

Various operating conditions for a blast furnace have been studied to search operating conditions that enable the productivity to be increased. As a result, the present invention has been completed based on the finding that the productivity can be increased with the stable operation of the blast furnace being maintained by charging partially reduced iron and adjusting an oxygen-enrichment ratio, a pulverized-coal injection rate, and a coke charging rate.

Specifically, the present invention provides a blast-furnace operating method in which iron-oxide raw material is reduced to obtain molten pig iron by charging the iron-oxide raw material, coke, and partially reduced iron from the furnace top of a blast furnace, and also injecting pulverized coal and oxygen-enriched air from a tuyere of the blast furnace. The blast-furnace operating method includes: a first step of adjusting a charging rate of the coke while monitoring whether a furnace-top temperature $T_{top}$ is within a predetermined temperature range; a second step of adjusting an injection rate of the pulverized coal while monitoring whether an in-furnace superficial gas velocity u and the furnace-top temperature $T_{top}$ are within predetermined ranges; a third step of adjusting an oxygen-enrichment ratio of the oxygen-enriched air while monitoring whether a combustion temperature $T_f$ at the tuyere and the furnace-top temperature $T_{top}$ are within predetermined ranges; and a fourth step of determining whether an injection rate of the oxygen-enriched air needs to be adjusted, based on a value of the in-furnace superficial gas velocity u.

By the above-described operating method, the productivity can be sufficiently increased with the stable operation of the blast furnace being maintained. In addition, the amount of coke used can be decreased. Specifically, when partially reduced iron is charged as part of raw material from the furnace top of the blast furnace, the amount of heat needed for reduction reaction of iron oxide decreases, and accordingly the temperature in the furnace increases and the furnace-top temperature $T_{top}$ increases. Consequently, compared to the case in which partially reduced iron is not charged, the oxygen-enrichment ratio can be further increased with the furnace-top temperature $T_{top}$ being maintained within a suitable range, whereby the productivity can be increased. The decreasing amount of heat needed for reduction reaction of iron oxide also enables the amount of coke used as a heat source to be decreased.

When the oxygen-enrichment ratio is increased, the tuyere combustion temperature $T_f$ increases. When the tuyere combustion temperature $T_f$ increases, ash that is mainly composed of $SiO_2$ contained in the iron-oxide raw material or the coke volatilizes in the raceways, and then is deposited in a packed-bed portion at the top to fill gaps, so that breathability in the furnace tends to deteriorate. To cope with this, for example, increasing the pulverized-coal injection rate is effective in preventing the tuyere combustion temperature $T_f$ from increasing. Thus, by increasing the pulverized-coal injection rate, the amount of heat consumed by thermal decomposition of the pulverized coal is increased, whereby the tuyere combustion temperature $T_f$ can be prevented from increasing.

On the other hand, if the pulverized-coal injection rate has been increased, the amount of gas generated in the furnace increases and the in-furnace superficial gas velocity u increases, so that a phenomenon such as scaffolding, flooding, or fluidization is more likely to occur. In view of this, when the pulverized-coal injection rate is increased, it is preferable to adjust the operating conditions of the blast furnace so as to prevent these phenomena from occurring. In the present invention, when partially reduced iron is charged as part of raw material, the coke charging rate, the oxygen-enrichment ratio of the oxygen-enriched air, and the pulverized-coal injection rate are adjusted, and also whether the injection rate of the oxygen-enriched air needs to be adjusted is determined. Accordingly, compared to the case in which such adjustment or determination is not made, the productivity can be increased by increasing the oxygen-enrichment ratio, and also the amount of coke used can be decreased.

After the oxygen-enrichment ratio of the oxygen-enriched air is adjusted, based on a result of determining whether the tuyere combustion temperature $T_f$ and the furnace-top temperature $T_{top}$ are within the predetermined ranges, the pulverized-coal injection rate may be adjusted. This adjustment enables the tuyere combustion temperature $T_f$ and the furnace-top temperature $T_{top}$ to be maintained within preferred ranges even if the oxygen-enrichment ratio changes. Thus, the stable operation can be maintained even if the oxygen-enrichment ratio is set higher than that of a conventional method.

If the pulverized-coal injection rate increases, the in-furnace superficial gas velocity increases, so that scaffolding, flooding, or fluidization is more likely to occur. To avoid such phenomena, based on a result of determining whether the in-furnace superficial gas velocity is within the predetermined range, the coke charging rate and/or the oxygen-enriched-air injection rate may be adjusted. This adjustment enables the productivity to be increased with the stable operation of the blast furnace being maintained. In addition, the coke ratio can be decreased to reduce the raw-material cost.

When the charging rate of the partially reduced iron is increased, at the first step, the charging rate of the coke may be decreased within a range where the furnace-top temperature $T_{top}$ satisfies the following expression (1). By this control, the amount of coke used can be decreased with the stable operation of the blast furnace being maintained.

$$T_{top} \geq T_{topmin} \quad (1)$$

where, in expression (1), $T_{topmin}$ is a given temperature that is set within a range equal to or lower than 120° C.

At the second step, the injection rate of the pulverized coal may be increased within ranges where the in-furnace superficial gas velocity u and the furnace-top temperature $T_{top}$ respectively satisfy the following expressions (2) and (3):

$$u \leq u_{max} \quad (2)$$

$$T_{top} \leq T_{topmax} \quad (3)$$

where, in expression (2), $u_{max}$ is a given velocity that is set within a range from 100 to 150 m/min, and in expression (3), $T_{topmax}$ is a given temperature that is set within a range equal to or higher than 180° C.

At the third step, the oxygen-enrichment ratio may be increased within a range where the combustion temperature $T_f$ and the furnace-top temperature $T_{top}$ respectively satisfy the following expression (4) and the above expression (1).

$$T_f \leq T_{fmax} \quad (4)$$

where, in expression (4), $T_{fmax}$ is a given temperature that is set within a range equal to or higher than 2300° C.

At the fourth step, whether the in-furnace superficial gas velocity u satisfies the above expression (2) is determined, and if the in-furnace superficial gas velocity u does not satisfy the above expression (2), the injection rate of the oxygen-enriched air may be decreased so that the in-furnace superficial gas velocity u satisfies the above expression (2). By this control, the productivity can be further increased with the operation of the blast furnace being maintained sufficiently stable.

By performing the first step, the second step, the third step, and the fourth step in this order, for example, excessive increase in the tuyere combustion temperature $T_f$ and excessive decrease in the furnace-top temperature $T_{top}$ can be avoided, whereby the stable operation of the blast furnace can be sufficiently maintained. In addition, because it is possible to decrease the coke ratio and increase the flow rate of the oxygen-enriched air while avoiding excessive increase in the in-furnace superficial gas velocity u, decrease in the coke ratio and improvement of the productivity can be simultaneously achieved at a high level.

After the fourth step, if the in-furnace superficial gas velocity u satisfies the following expression (7), or if the furnace-top temperature $T_{top}$ satisfies the following expression (8), the following operation may be performed if necessary. Specifically, the injection rate of the oxygen-enriched air may be increased, and then the first step, the second step, the third step, and the fourth step may be repeatedly performed. This operation enables the device capability of the blast furnace to be sufficiently utilized and the productivity to be further increased.

$$u < u_{max} \quad (7)$$

$$T_{top} > T_{topmin} \quad (8)$$

At the second step, the injection rate of the pulverized coal may be adjusted within a range exceeding 130 kilograms per ton of molten pig iron. Injecting the pulverized coal within this range enables the productivity to be further increased with the stable operation of the blast furnace being maintained.

The charging rate of the partially reduced iron may be adjusted within a range from 100 to 600 kilograms per ton of molten pig iron, or may be adjusted within a range from 100 to 300 kilograms per ton of molten pig iron. Charging the partially reduced iron within this range enables the productivity to be further increased with the stable operation of the blast furnace being maintained.

At the third step, the oxygen-enrichment ratio may be adjusted within a range exceeding 8% and equal to or lower than 16%. Adjusting the oxygen-enrichment ratio within this range enables the productivity to be further increased with the stable operation of the blast furnace being maintained.

The present invention provides a blast-furnace operating method in which iron-oxide raw material is reduced to obtain molten pig iron by charging the iron-oxide raw material, coke, and partially reduced iron from the furnace top of a blast furnace, and also injecting pulverized coal and oxygen-enriched air from a tuyere of the blast furnace. In this method, when an oxygen-enrichment ratio of the oxygen-enriched air is defined as x (%) and an injection rate of the pulverized coal per ton of molten pig iron is defined as y (kg/t), x and y satisfy the following expressions (9) and (10):

$$25x-175<y<31x+31 \quad (9)$$

$$y>130 \quad (10)$$

In the blast-furnace operating method of the present invention, the injection rate of the pulverized coal is adjusted high so as to exceed 130 kg/t with the partially reduced iron being charged. This adjustment enables the coke ratio to be decreased and the oxygen-enriched-air injection rate to be increased. The pulverized-coal injection rate is adjusted within a predetermined range depending on the oxygen-enrichment ratio, that is, a range satisfying expression (9). Thus, the operation of the blast furnace can be stably maintained.

The carbon content of the partially reduced iron may be 2.3 to 5.9% by mass, for example. This content enables the fuel ratio of the blast furnace to be decreased. The percentage of partially reduced iron having a particle diameter smaller than five millimeters in the whole of the partially reduced iron charged into the blast furnace may be equal to or lower than 10% by mass. The crushing strength of the partially reduced iron charged into the blast furnace may be equal to or higher than 30 kg/cm$^2$. These conditions enable the stable operation to be maintained at a higher level.

The present invention also provides a molten-pig-iron production method in which molten pig iron is produced based on the above-described blast-furnace operating method. By the molten-pig-iron production method, molten pig iron can be produced at a high productivity with the stable operation of the blast furnace being maintained.

Advantageous Effects of Invention

With the present invention, a blast-furnace operating method can be provided that makes it possible to sufficiently increase the productivity while maintaining the stable operation of the blast furnace. In addition, with the present invention, a molten-pig-iron production method can be provided that makes it possible to sufficiently increase the productivity while maintaining the stable operation of the blast furnace.

DESCRIPTION OF EMBODIMENTS

Preferred embodiments of the present invention will now be described with reference to the drawings in some cases. In the respective drawings, like numerals refer to like or similar elements, and duplicated explanations are omitted.

Figure 1:
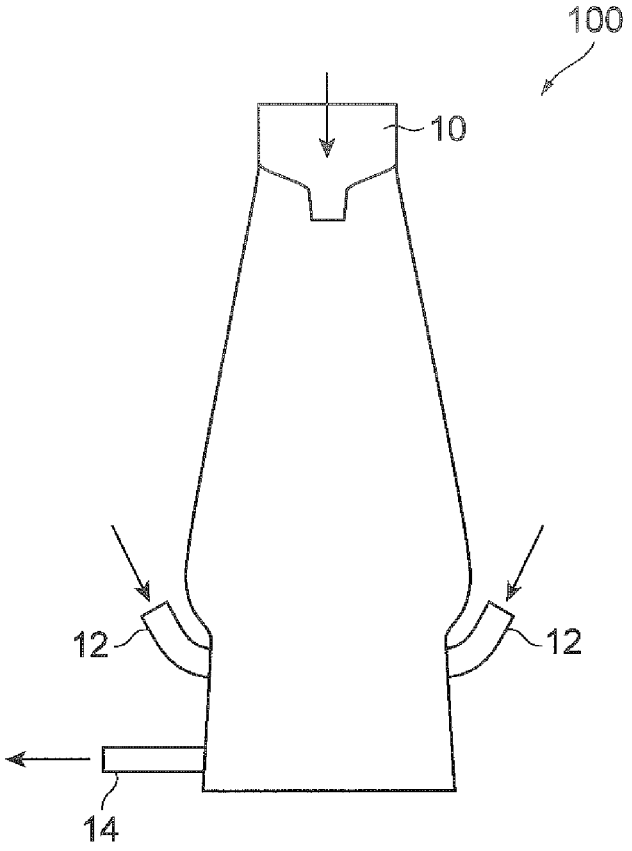
FIG. 1 is a schematic diagram illustrating one example of a blast furnace to which a blast-furnace operating method of the present invention is applied.

FIG. 1 is a schematic diagram illustrating one example of a blast furnace to which a blast-furnace operating method of the present embodiment is applied. Raw material is charged from a furnace top 10 of a blast furnace 100 into the blast furnace 100. The raw material contains iron-oxide raw material, coke, and partially reduced iron. The raw material may contain limestone, for example, as needed. As the iron-oxide raw material, various materials other than the partially reduced iron may be used, and examples thereof include lump ore, sintered ore, and pellets derived from iron ore.

The partially reduced iron is iron that is obtained by partially reducing iron oxide. The metallization ratio of partially reduced iron is a weight ratio of metallic iron contained in the partially reduced iron. The metallization ratio can be calculated by the following equation. The metallic iron content (M. Fe) and the total iron content (T. Fe) in the partially reduced iron can be measured by a conventional quantitative analysis.

$$\text{Metallization ratio (\%)}=[(\text{Metallic iron content in partially reduced iron})/(\text{Total iron content in partially reduced iron})]\times 100$$

The metallization ratio of the partially reduced iron of the present embodiment may be 50 to 94%, or may be 65 to 85%, for example. If the metallization ratio becomes excessively low, reduction reaction of the partially reduced iron is promoted in the blast furnace 100, and accordingly the in-furnace temperature tends to decrease and the coke ratio tends to increase. In contrast, if the metallization ratio becomes excessively high, it takes time for prereduction in producing the partially reduced iron, and accordingly the raw-material cost tends to increase.

The partially reduced iron can be obtained by, for example, directly reducing iron oxide with a reducing gas containing hydrogen and/or carbon monoxide. The partially reduced iron may be hot formed into an agglomerated form. This iron is called hot briquette iron (HBI). The partially reduced iron produced in a directly-reduced-iron plant is easily reoxidized during storage or transportation. This is because iron contained in the partially reduced iron reacts with and binds to oxygen in the air.

If iron (Fe) contained in partially reduced iron exists as iron carbide ($Fe_xC$, x=2 to 3), reoxidation of the partially reduced iron can be prevented. For example, if a half of iron (Fe) in partially reduced iron exists as $Fe_3C$, reoxidation of the partially reduced iron can be sufficiently prevented. In this case, the carbon content in the partially reduced iron is about 2.3% by mass when the metallization ratio is 94%. If the whole quantity of iron (Fe) in the partially reduced iron exists as $Fe_3C$, the carbon content in the partially reduced iron is about 4.6% by mass when the metallization ratio is 94%.

For example, the whole quantity of iron (Fe) in the partially reduced iron exists as $Fe_2C$, the carbon content in the partially reduced iron is about 5.9% by mass when the metallization ratio is 94%. Thus, the carbon content in the partially reduced iron may be 2.3 to 5.9% by mass. When the carbon content in the partially reduced iron is lower than 2.3% by mass, the content of $Fe_xC$ decreases and the partially reduced iron is more likely to be reoxidized. When the carbon content in the partially reduced iron exceeds 5.6% by mass, the amount of free carbon increases and the strength of the partially reduced iron tends to decrease. Partially reduced iron having a carbon content of 2.3 to 5.9% by mass has sufficient strength and also has a high content of iron carbide ($Fe_xC$), thereby sufficiently preventing reoxidation. Thus, such partially reduced iron can be used as raw material to be charged into the blast furnace 100 without being agglomerated. This eliminates the need for a facility for forming the partially reduced iron into HBI, thereby reducing the facility cost and the maintenance cost for the facility.

The carbon content in the partially reduced iron can be measured according to JIS 1211-2 (Iron and steel—Determination of carbon content—Part 2: Gas volumetric method after combustion), for example.

When partially reduced iron containing carbon is charged as raw material into the blast furnace 100, the carbon in the partially reduced iron acts as a reducing agent in the blast furnace 100. This action enables the fuel ratio of the blast furnace 100 to be decreased. Examples of a method of converting iron (Fe) in the partially reduced iron into iron carbide ($Fe_xC$) include a method of reducing iron oxide with a reducing gas containing methane ($CH_4$), for example. In this method, $Fe_xC$ can be generated by a reaction of formula (I). The content of $Fe_xC$ can be adjusted by controlling the reaction speeds of formulas (I) and (II). For example, by changing the water content in the reducing gas to adjust the speed of a methane reforming reaction of formula (II), the reaction speed of formula (I) can be adjusted.

$$xFe+CH_4 \rightarrow Fe_xC+2H_2 \quad (I)$$

$$CH_4+H_2O \rightarrow CO+3H_2 \quad (II)$$

In the above formula (I), x is a numerical value of 2.5 to 3.

Partially reduced iron that is not agglomerated tends to have a smaller particle size and also have a lower strength than partially reduced iron (HBI) that is agglomerated. In contrast, the iron-oxide raw material used for the blast furnace 100 preferably has a predetermined particle size and a predetermined strength from a viewpoint of further improving the stability of operation. From a simulation result of operation of the blast furnace 100, the percentage of iron-oxide raw material having a particle diameter smaller than five millimeters in the whole of iron-oxide raw material charged into the blast furnace 100 may be equal to or lower than 10% by mass. By using iron-oxide raw material having such particle-diameter distribution, breathability in the blast furnace 100 becomes preferable, and thus the stability of operation can be further improved. In consideration of such a fact, also for the partially reduced iron charged into the blast furnace 100, similarly to the iron-oxide raw material, the percentage of partially reduced iron having a particle diameter smaller than five millimeters in the whole of the partially reduced iron charged into the blast furnace 100 may be equal to or lower than 10% by mass.

The particle diameters of the iron-oxide raw material and the partially reduced iron in the present specification can be measured according to JIS M 8700:2013 "particle size analysis". Specifically, screening is performed with a sieve having an aperture size of five millimeters, and the mass percentage of specimens that have passed through the sieve with respect to the whole of specimens can be used as the percentage of specimens having a particle diameter smaller than five millimeters.

Before being charged into the blast furnace 100, the raw material such as the partially reduced iron charged into the blast furnace 100 is subjected to impact due to dropping at connections of a conveyor. From a viewpoint of sufficiently preventing crushing due to this impact, the partially reduced iron may have a crushing strength equal to or higher than 30 $kg/cm^2$. This strength is sufficiently higher than the maximum value of stress to which the partially reduced iron is subjected in the blast furnace 100. Thus, the crushing strength of the partially reduced iron charged into the blast furnace 100 may be equal to or higher than 30 $kg/cm^2$. The crushing strength of the partially reduced iron can be set equal to or higher than 30 $kg/cm^2$ by adjusting the carbon content in the partially reduced iron. The carbon content in the partially reduced iron can be adjusted by controlling the water content in the reducing gas.

Figure 2:
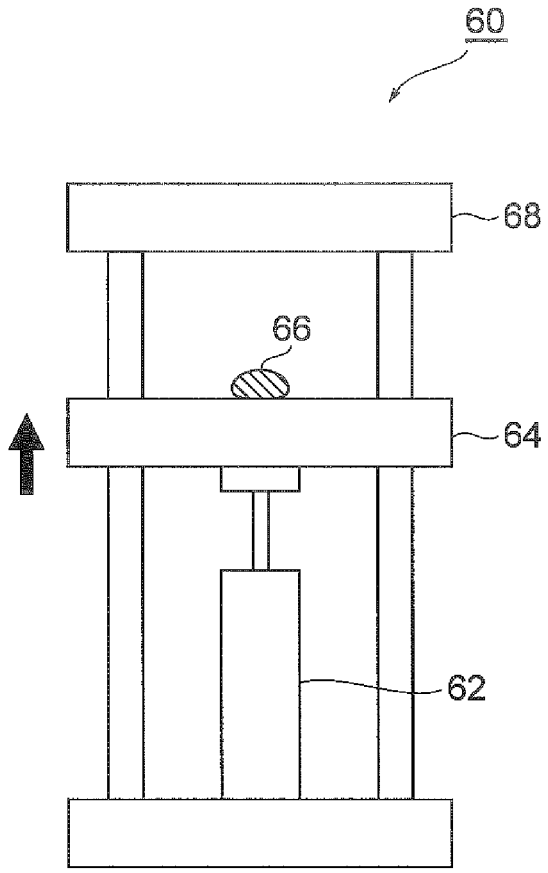
FIG. 2 is a front view of a measuring device for measuring crushing strength of partially reduced iron.

The crushing strength in the present specification is measured by the following procedure using a measuring device 60 depicted in FIG. 2. In the measuring device 60 of FIG. 2, a specimen 66 that is a piece to be measured is put on a movable plate 64 mounted on a hydraulic jack 62 that can measure compression pressure. A cylinder of the hydraulic jack 62 is extended upward to move the movable plate 64 upward. Accordingly, the specimen 66 is sandwiched between the movable plate 64 and a fixed plate 68 that is fixed above the movable plate 64. Load is applied to the specimen 66, and the specimen 66 is finally crushed. From the load at the time of crushing, the crushing strength is obtained.

From tuyeres 12 provided to a lower portion of the blast furnace 100, oxygen-enriched air is injected as hot air into the furnace. The oxygen-enriched air can be obtained by mixing air and oxygen. The oxygen-enrichment ratio can be adjusted by changing a mixing ratio of the air and the oxygen. Pulverized coal is injected from the tuyeres 12 into the blast furnace 100 together with the oxygen-enriched air.

In the blast furnace 100, by reducing the iron-oxide raw material and the partially reduced iron, molten pig iron is obtained. The molten pig iron is discharged from a tapping hole 14 to outside the furnace. Pig iron is obtained by cooling the molten pig iron thus obtained. By the blast-furnace operating method of the present embodiment, a productivity of, for example, 2.51 to 3.65 $t/(d \cdot m^3)$, more specifically, 3 to 3.65 $t/(d \cdot m^3)$ can be achieved. The productivity is weight (ton) of molten pig iron obtained per day and per cubic meters of inner volume of the blast furnace 100. The inner volume of the blast furnace 100 is 1500 to 3000 $m^3$, for example.

Figure 3:
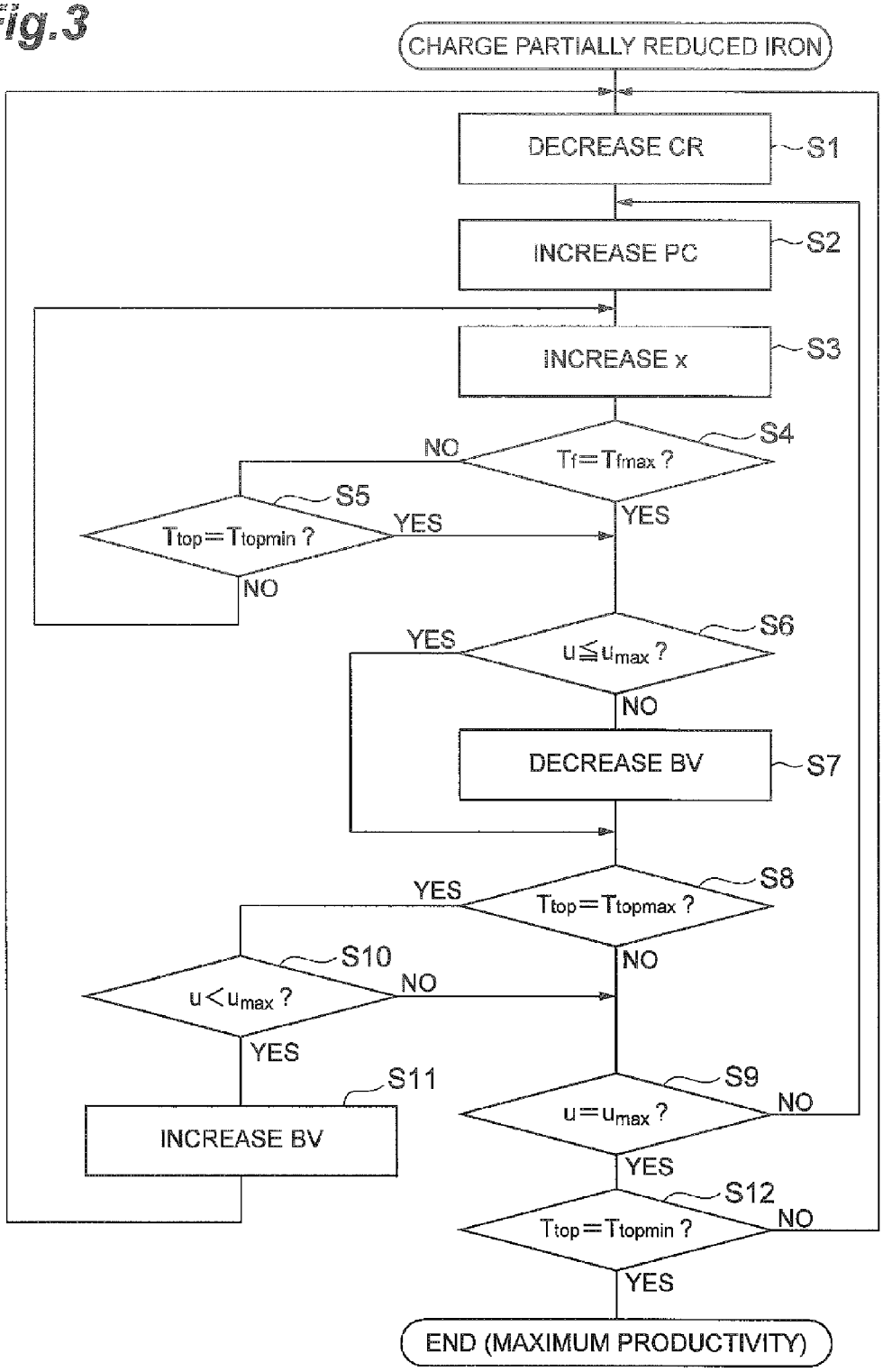
FIG. 3 is a flowchart illustrating an embodiment of the blast-furnace operating method of the present invention.

FIG. 3 is a flowchart illustrating a procedure of the blast-furnace operating method of the present embodiment. In FIG. 3, $T_{top}$ and $T_f$ are the gas temperature (furnace-top temperature) at the furnace top of the blast furnace 100 and the combustion temperature at the tuyeres 12, respectively. In the blast furnace 100, the relation of $T_{top}<T_f$ holds, and $T_f$ is generally a maximum temperature at the inside of the blast furnace 100. $T_f$ is generally 2200 to 2400° C. The upper limit ($T_{fmax}$) of $T_f$ may be set equal to or higher than 2300° C., or may be set between 2300 and 2400° C., for example, from a viewpoint of satisfying both of the stable operation of the blast furnace 100 and a higher productivity at a higher level.

$T_{top}$ is generally a minimum temperature at the inside of the blast furnace 100. $T_{top}$ is generally 100 to 200° C., for example. $T_{top}$ needs to be set within a predetermined temperature range at the top inside the furnace from a viewpoint of suitably reducing the iron-oxide raw material to stabilize the operation of the blast furnace 100. The upper limit ($T_{topmax}$) of $T_{top}$ may be set equal to or higher than 180° C., or may be set between 180 and 200° C. The lower limit ($T_{topmin}$) of $T_{top}$ may be set equal to or lower than 120° C., or may be set between 100 and 120° C.

In FIG. 3, x is an oxygen-enrichment ratio (unit: %) of oxygen-enriched air. PC is the injection rate of pulverized coal per ton (unit: kg/t) of molten pig iron injected from the tuyeres 12. CR is a coke ratio (weight of coke charged per ton of molten pig iron, unit: kg/t). From a viewpoint of reducing the raw-material cost, it is preferable to lower the coke ratio.

In FIG. 3, BV is a flow rate (unit: $Nm^3$/min) of the oxygen-enriched air fed into the furnace from the tuyeres 12, u is in-furnace superficial gas velocity (unit: m/s), and u can be obtained by the following equation:

$u$ (m/s)=[volumetric flow rate ($m^3$/s) of in-furnace gas]/[cross-sectional area ($m^2$) of blast furnace 100 at belly portion].

From a viewpoint of smoothly proceeding reduction reaction in the inside of the blast furnace 100, u is 100 to 150 m/min, for example. The upper limit ($u_{max}$) of u is generally about 100 to 150 m/min, which is a maximum in-furnace superficial gas velocity at which scaffolding, flooding, or fluidization does not occur in a blast furnace, and $u_{max}$ may be set between 140 to 150 m/min, for example.

Based on the flowchart of FIG. 3, the blast-furnace operating method will be described in detail. To begin with, iron-oxide raw material, coke, and partially reduced iron are charged from the furnace top of the blast furnace 100. For one ton of molten pig iron, for example, 1100 to 1600 kilograms of iron-oxide raw material, 200 to 400 kilograms of coke, and 100 to 600 kilograms of partially reduced iron are charged. By charging the iron-oxide raw material, the coke, and the partially reduced iron in such a mass ratio, further stable operation can be performed at a lower raw-material cost.

The charging amount of the partially reduced iron is 100 to 600 kilograms, for example, and may be 100 to 300 kilograms per ton of molten pig iron. By charging the partially reduced iron in such a range, the productivity can be sufficiently increased at a lower raw-material cost. The content of metallic iron contained in the partially reduced iron charged into the blast furnace 100 is 75 to 79% by mass, for example.

When charging of the partially reduced iron is started or the charging amount of the partially reduced iron is increased, the charging amount of the iron oxide can be decreased in accordance with the increase of the charging amount of the partially reduced iron. As the charging amount of the iron oxide decreases, the amount of iron oxide that undergoes a reduction reaction decreases, so that the heat amount needed for the reduction reaction becomes superfluous. Accordingly, the in-furnace temperature of the blast furnace 100 increases, and $T_{top}$ also increases at the same time. Consequently, CR can be decreased. Then, while $T_{top}$ is being monitored so as to constantly satisfy the following expression (1), CR is decreased by a small amount (S1, first step). For example, CR may be decreased by one kilogram per ton of molten pig iron. The term "being monitored" herein indicates that the value of $T_{top}$ is always or occasionally measured, and some measures can be immediately taken when $T_{top}$ is about to deviate from the target range represented by expression (1). For example, when $T_{top}$ is about to deviate from the target range, the operation of decreasing CR may be paused or stopped. The later-described term "being monitored" for each temperature and velocity is similarly defined.

$$T_{top} \geq T_{topmin} \quad (1)$$

After CR is decreased at the first step, the in-furnace superficial gas velocity u decreases, and also the in-furnace temperature of the blast furnace 100 decreases, so that $T_{top}$ decreases. Then, while u and $T_{top}$ is being monitored so as to satisfy the following expressions (2) and (3), PC is increased (S2, second step). It is preferable to increase PC in small increments. In the operation herein, PC may be increased by one kilogram per ton of molten pig iron.

$$u \leq u_{max} \quad (2)$$

$$T_{top} \leq T_{topmax} \quad (3)$$

After PC is increased at the second step, there is a tendency that $T_f$ decreases and $T_{top}$ increases, and thus the oxygen-enrichment ratio x of the oxygen-enriched air can be increased. Then, the oxygen-enrichment ratio x is increased (S3). Then, whether $T_f=T_{fmax}$ is satisfied is determined (S4). If $T_f=T_{fmax}$ is not satisfied, whether $T_{top}=T_{topmin}$ is satisfied is determined (S5). In this manner, while $T_f$ and $T_{top}$ are being monitored so as to satisfy expression (4) below and the above expression (1), the oxygen-enrichment ratio x of the oxygen-enriched air is increased until $T_f=T_{fmax}$ and/or $T_{top}=T_{topmin}$ is determined (third step).

At the third step, it is preferable to increase the oxygen-enrichment ratio x in small increments. The oxygen-enrichment ratio x may be increased by 0.1% each time, for example. The oxygen-enrichment ratio x is equal to or higher than 6%, for example, and may exceed 8% and be equal to or lower than 16%. The oxygen-enrichment ratio x in the present specification is a difference between the oxygen concentrations (volumetric basis) of the oxygen-enriched air and the atmosphere under standard conditions (25° C., $10^5$ Pa). In FIG. 3, after it is determined that $T_f=T_{fmax}$ is not satisfied at S4, whether $T_{top}=T_{topmin}$ is satisfied is determined at S5. However, the determination order is not limited to this. For example, after it is determined that $T_{top}=T_{topmin}$ is not satisfied, whether $T_f=T_{fmax}$ is satisfied may be determined.

$$T_f \leq T_{fmax} \quad (4)$$

After the oxygen-enrichment ratio x is increased at the third step, along with the increase in $T_f$ and the decrease in $T_{top}$, u increases. Then, whether u satisfies the above expression (2) is determined (S6). By this determination, whether the adjustment of the injection rate of the oxygen-enriched air is necessary is determined. If it is determined that u does not satisfy the above expression (2), the oxygen-enriched-air injection flow rate BV is decreased (S7). In this manner, adjustment is made so that u satisfies the above expression (2) (fourth step).

Next, whether $T_{top}=T_{topmax}$ is satisfied is determined (S8). If $T_{top}=T_{topmax}$ is not satisfied, whether $u=u_{max}$ is satisfied is determined (S9). If it is determined that $u=u_{max}$ is not satisfied at S9, the second step, the third step, and the fourth step described above are performed again. In this manner, until $u=u_{max}$ and/or $T_{top}=T_{topmax}$ is satisfied, each step of the second step, the third step, and the fourth step described above is repeatedly performed, whereby PC is increased. Consequently, along with the increase of PC, the oxygen-enrichment ratio x can be increased. The oxygen-enrichment ratio x may be equal to or higher than 6%, or may exceed 8% and be equal to or lower than 16%. When the oxygen-enrichment ratio x increases, the percentage of oxygen in the oxygen-enriched air increases. By this increase, the amount of reaction that proceeds per unit time in the inside of the blast furnace 100 increases, so that the productivity increases.

When PC is increased by repeatedly performing each step of the second step, the third step, and the fourth step, u also tends to increase. After the fourth step is completed, if it is determined that $T_{top}=T_{topmax}$ is satisfied at S8, whether u satisfies the following expression (7) is determined (S10). If it is determined that u satisfies the following expression (7) at S10, the oxygen-enriched-air injection flow rate BV is increased until $u=u_{max}$ is satisfied (S11). By this increasing, u can be adjusted so as to satisfy $u=u_{max}$ (fifth step).

$$u<u_{max} \tag{7}$$

Thereafter, if CR can be further decreased, a series of steps of the first step, the second step, the third step, and the fourth step, or a series of steps in which a fifth step is further added to these steps may be repeatedly performed. If it is determined that $u=u_{max}$ is satisfied at S9, whether $T_{top}$ satisfies $T_{top}=T_{topmin}$ is further determined (S12). As a result, if it is determined that both of $u=u_{max}$ and $T_{top}$ satisfies $T_{top}=T_{topmin}$ are satisfied at S9 and S12, the procedure of the flowchart depicted in FIG. 3 is completed. In this manner, the productivity can be maximized.

If it is determined that u satisfies the above expression (7) at S10, after BV is increased until $u=u_{max}$ is satisfied at S11, it may be difficult to decrease CR depending on temperature conditions (furnace conditions) in the blast furnace 100. In such a case, or if the value of CR has already reached the target value, the series of steps may be completed after increasing BV at S11.

The pulverized coal acts as a reducing agent in the inside of the blast furnace 100, and can substitute for the coke. Thus, when PC is increased, CR can be further decreased. It is preferable to adjust CR so that the amount of iron oxide reduced and the amount of coke needed for maintaining the in-furnace temperature of the blast furnace 100 can be secured. After the above-described fourth step, if it is determined that u satisfies the above expression (7) and/or if $T_{top}$ satisfies the following expression (8), CR can be further decreased.

$$T_{top}>T_{topmin} \tag{8}$$

Each step of the first step, the second step, the third step, the fourth step, and the fifth step described above may be repeatedly performed until $T_{top}$ satisfies $T_{top}=T_{topmin}$ and u satisfies $u=u_{max}$. Alternatively, each step of the first step, the second step, the third step, the fourth step, and the fifth step described above may be repeatedly performed until it is determined that CR cannot be further decreased.

When the blast furnace 100 is operated based on CR, PC, x, and BV determined by the above-described procedure, it is possible to sufficiently increase the productivity and also decrease the coke ratio in a stable operating state.

By performing the steps indicated in the flowchart of FIG. 3, the blast furnace 100 can be operated under the following conditions. Specifically, when the oxygen-enrichment ratio of the oxygen-enriched air is defined as x (%) and the injection rate of the pulverized coal per ton of molten pig iron is defined as y (kg/t), x and y satisfy the following expressions (9) and (10).

$$25x-175<y<31x+31 \tag{9}$$

$$y>130 \tag{10}$$

When the pulverized-coal ratio y is equal to or lower than "25x−175", a phenomenon in which $T_{top}$ decreases or a phenomenon in which $T_f$ increases occurs, making it difficult to maintain the stable operation of the blast furnace. When the pulverized-coal ratio y is equal to or higher than "31x+31", a phenomenon in which $T_{top}$ increases, a phenomenon in which u increases, and/or a phenomenon in which the air ratio decreases, for example, occurs. Such phenomena make it difficult to maintain the stable operation of the blast furnace.

From a viewpoint of decreasing the coke ratio and increasing the productivity, the pulverized-coal ratio y is within a range exceeding 130 kg/t, for example, and may be within a range exceeding 175 kg/t. The pulverized-coal ratio y may be equal to or lower than 250 kg/t from a viewpoint of maintaining further stable operation. From a viewpoint of further increasing the productivity, the oxygen-enrichment ratio x may be equal to or higher than 6%, for example, or may be within a range exceeding 8%. The oxygen-enrichment ratio x is equal to or lower than 16%, for example, from a viewpoint of reducing the oxygen cost.

From a viewpoint of further increasing the productivity, the charging amount of the partially reduced iron into the blast furnace 100 is equal to or larger than 100 kilograms per ton of molten pig iron. However, from a viewpoint of reducing the raw-material cost, the charging amount of the partially reduced iron into the blast furnace 100 is equal to or smaller than 600 kilograms per ton of molten pig iron.

As described in the foregoing, by performing the method for operating the blast furnace 100, molten pig iron can be produced at a high productivity. Therefore, the blast-furnace operating method of the present embodiment is considered to be a molten-pig-iron production method that makes it possible to stably produce molten pig iron at a high productivity.

The preferred embodiments of the present invention have been described above, but the present invention is not limited to the above-described embodiments. For example, the respective steps of S1 to S5 do not necessarily have to be repeatedly performed, and may be performed only once. Furthermore, the respective steps of S1 to S5 may be consecutively performed, or may be intermittently performed.

EXAMPLES

The present invention will be described in further detail hereinafter with reference to examples and comparative examples. However, the present invention is not limited to the following examples.

Example 1

Into a blast furnace (inner volume: 1600 $m^3$) as depicted in FIG. 1, iron-oxide raw material and coke were charged, and also oxygen-enriched air and pulverized coal were injected from tuyeres to produce molten pig iron. Then, partially reduced iron (metallization ratio: 82%, carbon content: 3.5%) was charged at 100 kg/t, and the operation depicted in FIG. 3 was performed to obtain operating conditions under which the blast furnace can be stably operated. The results are plotted on FIG. 4. In Example 1, out of some operating conditions plotted on FIG. 4, under the operating condition of oxygen-enrichment ratio x: 13.2% and pulverized-coal ratio y: 238 kg/t, a productivity of 2.87 t/(d·$m^3$) could be achieved.

Example 2

Operating conditions under which the blast furnace can be stably operated were obtained by the same method as in Example 1 except setting the charging amount of partially reduced iron at 200 kg/t. The results are plotted on FIG. 4. In Example 2, out of some operating conditions plotted on FIG. 4, under the operating condition of oxygen-enrichment ratio x: 16% and pulverized-coal ratio y: 237 kg/t, a productivity of 2.94 t/(d·$m^3$) could be achieved.

Example 3

Operating conditions under which the blast furnace can be stably operated were obtained by the same method as in Example 1 except setting the charging amount of partially reduced iron at 300 kg/t. The results are plotted on FIG. 4. In Example 3, out of some operating conditions plotted on FIG. 4, under the operating condition of oxygen-enrichment ratio x: 16% and pulverized-coal ratio y: 225 kg/t, a productivity of 3.09 t/(d·$m^3$) could be achieved.

Example 4

Operating conditions under which the blast furnace can be stably operated were obtained by the same method as in Example 1 except setting the charging amount of partially reduced iron at 400 kg/t. The results are plotted on FIG. 4. In Example 4, out of some operating conditions plotted on FIG. 4, under the operating condition of oxygen-enrichment ratio x: 14% and pulverized-coal ratio y: 210 kg/t, a productivity of 3.25 t/(d·$m^3$) could be achieved.

Example 5

Operating conditions under which the blast furnace can be stably operated were obtained by the same method as in Example 1 except setting the charging amount of partially reduced iron at 500 kg/t. The results are plotted on FIG. 4. In Example 5, out of some operating conditions plotted on FIG. 4, under the operating condition of oxygen-enrichment ratio x: 14% and pulverized-coal ratio y: 198 kg/t, a productivity of 3.44 t/(d·$m^3$) could be achieved.

Example 6

Operating conditions under which the blast furnace can be stably operated were obtained by the same method as in Example 1 except setting the charging amount of partially reduced iron at 600 kg/t. The results are plotted on FIG. 4. In Example 6, out of some operating conditions plotted on FIG. 4, under the operating condition of oxygen-enrichment ratio x: 14% and pulverized-coal ratio y: 190 kg/t, a productivity of 3.63 t/(d·$m^3$) could be achieved.

Comparative Example 1

The charging amount of partially reduced iron was set at 400 kg/t, and the blast furnace was operated with the pulverized-coal ratio and the oxygen-enrichment ratio being maintained at constant values, without performing the operation depicted in FIG. 3. The blast furnace was stably operated at an oxygen-enrichment ratio x ranging from 3.2% to 7.8%, but the productivity was 2.19 to 2.38 t/(d·$m^3$).

Comparative Example 2

Into a blast furnace (inner volume: 1600 $m^3$) as depicted in FIG. 1, iron-oxide raw material and coke were charged, and also oxygen-enriched air and pulverized coal were injected from tuyeres to produce molten pig iron. Then, the same partially reduced iron as used in Example 1 was charged, and the blast furnace was operated with the oxygen-enrichment ratio and the pulverized-coal ratio being adjusted. In Comparative Example 2, the oxygen-enrichment ratio x and the pulverized-coal ratio y were adjusted at the values plotted on FIG. 4, and the procedure indicated in the flowchart depicted in FIG. 3 was attempted. However, the furnace-top temperature ($T_{top}$), the in-furnace superficial gas velocity (u), the tuyere combustion temperature ($T_f$), or the air ratio deviated from the range for maintaining the stable condition, so that the stable operation could not be performed. In Comparative Example 2, the charging amount of partially reduced iron was set at 200 to 600 kg/t.

Comparative Example 3

The blast furnace was operated by the same method as in Example 1 except that the partially reduced iron was not charged. The results are plotted on FIG. 4. Although the blast furnace was stably operated, the oxygen-enrichment ratio could not be increased.

Figure 4:
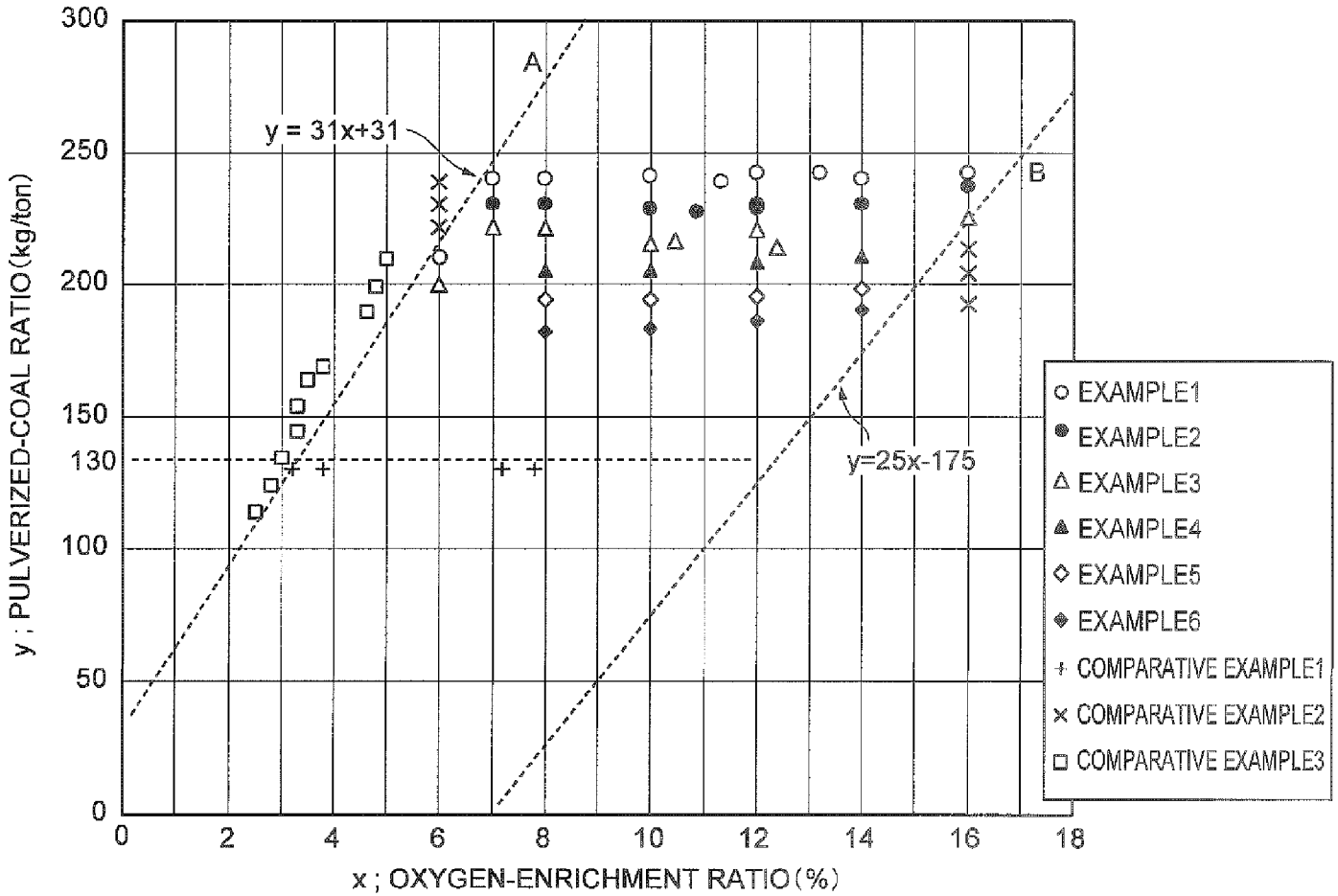
FIG. 4 is a graph illustrating a relation between oxygen-enrichment ratios and pulverized-coal ratios of Examples 1 to 6 and Comparative Examples 1 to 3.

As depicted in FIG. 4, in an area satisfying $y>130$ between line A ($y=31x+31$) and line B ($y=25x-175$), it was confirmed that the stable operation could be maintained. All of $y=130$, line A, and line B correspond to border lines that divide the data points between Examples and Comparative Examples. Specifically, assuming that the oxygen-enrichment ratio of the oxygen-enriched air is defined as x (%) and the pulverized-coal ratio is defined as y (kg/t), when x and y satisfy the above expressions (5) and (6), the stable operation of the blast furnace can be maintained.

Comparative Example 4

Into a blast furnace (inner volume: 1600 $m^3$) as depicted in FIG. 1, iron-oxide raw material and coke were charged, also oxygen-enriched air and pulverized coal were injected from tuyeres, and the blast furnace was operated to produce molten pig iron. Then, partially reduced iron was not charged, and the oxygen-enrichment ratio and the pulverized-coal ratio were set constant. The operating conditions and results of productivity and the coke ratio are given in Table 1.

Comparative Examples 5 to 7

The blast furnace was operated to produce molten pig iron by the same method as in Comparative Example 4 except that the partially reduced iron the same as that used in Example 1 was charged at the amounts given in Table 1. The oxygen-enrichment ratio and the pulverized-coal ratio were set constant similarly to Comparative Example 4. The operating conditions and results of productivity and the coke ratio are given in Table 1.

Comparative Examples 7 to 9

The partially reduced iron the same as that used in Example 1 was charged at the amounts given in Table 1, and the procedure indicated in the flowchart of FIG. 3 was performed. The oxygen-enrichment ratio and the pulverized-coal ratio after the procedure was performed are given in Table 1. The operating conditions and results of productivity and the coke ratio are given in Table 1.

TABLE 1

| | | Comparative Example 4 | Comparative Example 5 | Example 7 | Comparative Example 6 | Example 8 | Comparative Example 7 | Example 9 |
|---|---|---|---|---|---|---|---|---|
| Partially reduced iron | kg/t | 0 | 100 | 100 | 200 | 200 | 300 | 300 |
| Oxygen-enrichment ratio | % | 4.4 | 4.4 | 12 | 4.4 | 12 | 4.4 | 12 |
| Pulverized-coal ratio | kg/t | 126 | 126 | 240 | 126 | 230 | 126 | 220 |
| Productivity | $t/(d \cdot m^3)$ | 2.23 | 2.33 | 2.75 | 2.46 | 2.87 | 2.59 | 3.02 |
| Coke ratio | kg/t | 407.2 | 379.7 | 278.7 | 351.2 | 261.2 | 322.7 | 242.7 |

As given in Table 1, it was confirmed that the productivity could be increased and the coke ratio could be decreased in Examples 7 to 9 in which the partially reduced iron was charged and the procedure indicated in the flowchart of FIG. 3 was performed. In addition, the stable operation could be maintained in all of the Examples.

Figure 5:
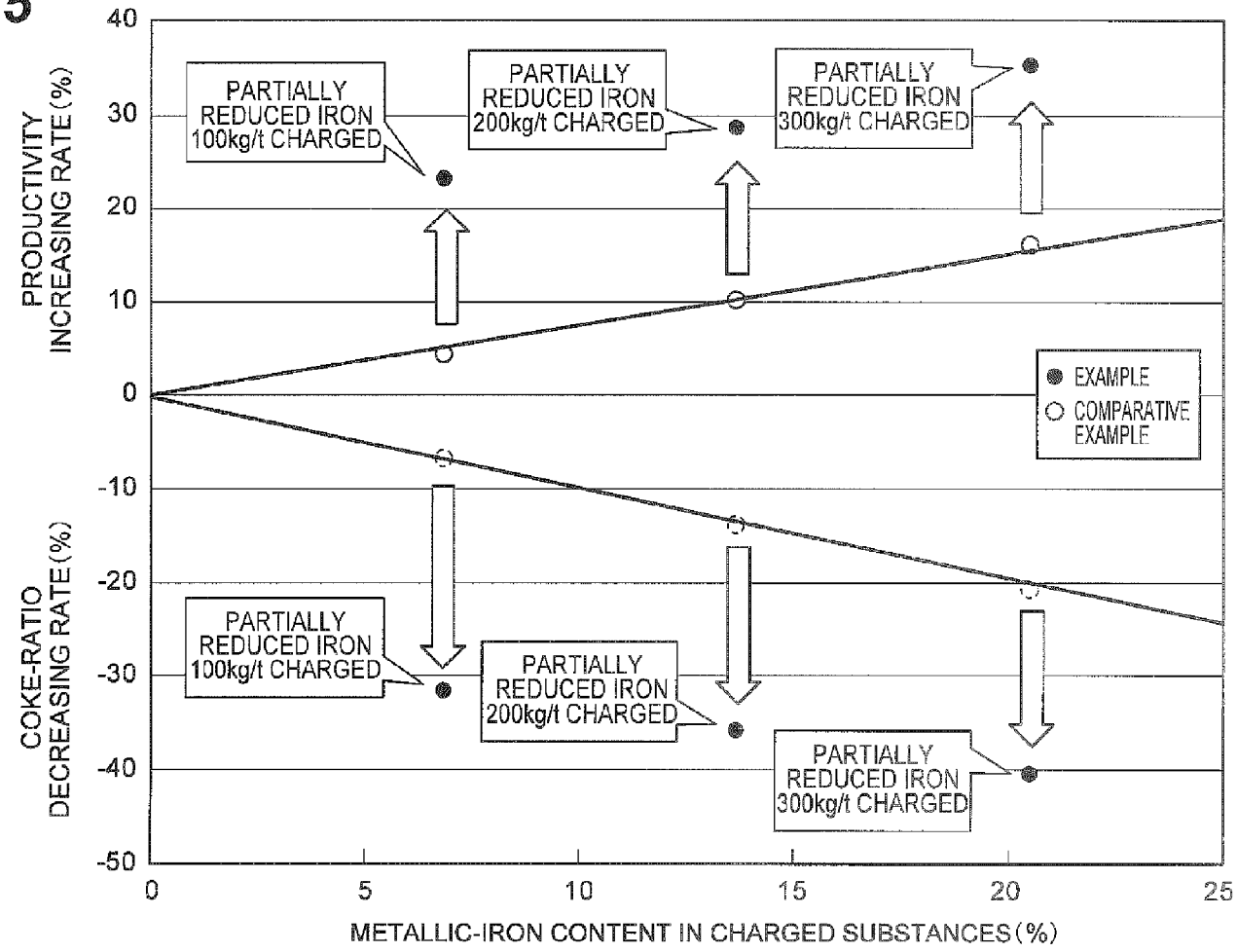
FIG. 5 is a graph illustrating relations of metallic-iron contents versus productivity increasing rates and coke-ratio decreasing rates of Examples 7 to 9 and Comparative Examples 5 to 7 with respect to Comparative Example 4.

FIG. 5 is a graph plotted of productivity increasing rates and coke-ratio decreasing rates of Examples 7 to 9 and Comparative Examples 5 to 7 with respect to Comparative Example 4. In FIG. 5, symbols "○" in solid line and in dotted line indicate Comparative Examples 5 to 7, and symbols "●" indicate Examples 7 to 9. The abscissa in FIG. 5 represents the metallic-iron content (mass basis) in the total amount of the iron-oxide raw material and the partially reduced iron. From the results in FIG. 5, it was confirmed that the productivity could be increased and the coke ratio could be decreased when the metallic-iron content increased, that is, when the amount of partially reduced iron increased. In addition, it was confirmed that not only simply charging the partially reduced iron but also adjusting the operation in accordance with the charging amount of the partially reduced iron enabled the stable operation of the blast furnace and also enabled the productivity to be increased.

INDUSTRIAL APPLICABILITY

With the present invention, a blast-furnace operating method can be provided that makes it possible to sufficiently increase the productivity while maintaining the stable operation of the blast furnace. In addition, with the present invention, a pig-iron production method can be provided that makes it possible to sufficiently increase the productivity while maintaining the stable operation of the blast furnace.

REFERENCE SIGNS LIST

10: furnace top, 12: tuyere, 14: tapping hole, 60: measuring device, 62: hydraulic jack, 64: movable plate, 66: specimen, 68: fixed plate, 100: blast furnace

The invention claimed is:

1. A blast-furnace operating method in which iron-oxide raw material is reduced to obtain molten pig iron by charging the iron-oxide raw material, coke, and partially reduced iron from the furnace top of a blast furnace, and also injecting pulverized coal and oxygen-enriched air from a tuyere of the blast furnace, the blast-furnace operating method comprising:

a first step of adjusting a charging rate of the coke while monitoring a furnace-top temperature $T_{top}$;

a second step of adjusting an injection rate of the pulverized coal while monitoring an in-furnace superficial gas velocity u and the furnace-top temperature $T_{top}$;

a third step of adjusting an oxygen-enrichment ratio of the oxygen-enriched air while monitoring a combustion temperature $T_f$ at the tuyere and the furnace-top temperature $T_{top}$; and a fourth step of determining whether an injection rate of the oxygen-enriched air needs to be adjusted, based on a value of the in-furnace superficial gas velocity u.

2. The blast-furnace operating method according to claim 1, wherein when a charging rate of the partially reduced iron is increased, at the first step, the charging rate of the coke is decreased within a range where the furnace-top temperature $T_{top}$ satisfies the following expression (1):

$$T_{top} > T_{topmin} \quad (1)$$

wherein $T_{topmin}$ is a given temperature that is set within a range equal to or lower than 120° C.;

at the second step, the injection rate of the pulverized coal is increased within ranges where the in-furnace superficial gas velocity u and the furnace-top temperature $T_{top}$ respectively satisfy the following expressions (2) and (3):

$$u \leq u_{max} \quad (2)$$

$$T_{top} \leq T_{topmax} \quad (3)$$

wherein $u_{max}$ is a given velocity that is set within a range from 100 to 150 m/min, and $T_{topmax}$ is a given temperature that is set within a range equal to or higher than 180° C.;

at the third step, the oxygen-enrichment ratio is increased within a range where the furnace-top temperature $T_{top}$ and the combustion temperature $T_f$ respectively satisfy the above expression (1) and the following expression (4):

$$T_f \leq T_{fmax} \quad (4)$$

wherein $T_{fmax}$ is a given temperature that is set within a range equal to or higher than 2300° C.; and at the fourth step, if the in-furnace superficial gas velocity u does not satisfy the above expression (2), the injection rate of the oxygen-enriched air is decreased so that the in-furnace superficial gas velocity u satisfies the above expression (2).

3. The blast-furnace operating method according to claim 1, wherein after the fourth step, the second step, the third step, and the fourth step are repeatedly performed until the in-furnace superficial gas velocity u satisfies the following expression (5):

$$u = u_{max} \quad (5), \text{ and/or}$$

until the furnace-top temperature $T_{top}$ satisfies the following expression (6):

$$T_{top} = T_{topmin} \quad (6)$$

wherein $u_{max}$ is a given velocity that is set within a range from 100 to 150 m/min, and wherein $T_{topmin}$ is a given temperature that is set within a range equal to or lower than 120° C.

4. The blast-furnace operating method according to claim 1, wherein after the fourth step, if the in-furnace superficial gas velocity u satisfies the following expression (7):

$$u < u_{max} \quad (7),$$

the injection rate of the oxygen-enriched air is increased, and then the first step, the second step, the third step, and the fourth step are repeatedly performed, wherein $u_{max}$ is a given velocity that is set within a range from 100 to 150 m/min.

5. The blast-furnace operating method according to claim 1, wherein after the fourth step, if the furnace-top temperature $T_{top}$ satisfies the following expression (8):

$$T_{top} > T_{topmin} \quad (8),$$

the first step, the second step, the third step, and the fourth step are repeatedly performed, wherein $T_{topmin}$ is a given temperature that is set within a range equal to or lower than 120° C.

6. The blast-furnace operating method according to claim 1, wherein at the third step, the oxygen-enrichment ratio is adjusted within a range exceeding 8% and equal to or lower than 16%.

7. The blast-furnace operating method according to claim 1, wherein the injection rate of the pulverized coal exceeds 130 kilograms per ton of molten pig iron.

8. The blast-furnace operating method according to claim 1, wherein a charging rate of the partially reduced iron is 100 to 600 kilograms per ton of molten pig iron.

9. The blast-furnace operating method according to claim 1, wherein a carbon content of the partially reduced iron is 2.3 to 5.9% by mass.

10. The blast-furnace operating method according to claim 1, wherein a percentage of partially reduced iron having a particle diameter smaller than five millimeters in a whole of the partially reduced iron charged into the blast furnace is equal to or lower than 10% by mass.

11. The blast-furnace operating method according to claim 1, wherein a crushing strength of the partially reduced iron charged into the blast furnace is equal to or higher than 30 kg/cm$^2$.

12. A molten-pig-iron production method comprising producing molten pig iron by the blast-furnace operating method according to claim 1.

13. The blast-furnace operating method according to claim 1, wherein when an oxygen-enrichment ratio of the oxygen-enriched air is defined as x (%) and an injection rate of the pulverized coal per ton of molten pig iron is defined as y (kg/t), x and y satisfy the following expressions (9) and (10):

$$25x - 175 < y < 31x + 31 \quad (9)$$

$$y > 130 \quad (10),$$

wherein a charging amount of the partially reduced iron is 100 to 600 kilograms per ton of molten pig iron, and wherein the oxygen-enrichment ratio is adjusted within a range exceeding 8% and equal to or lower than 16%.

14. The blast-furnace operating method according to claim 13, wherein a carbon content of the partially reduced iron is 2.3 to 5.9% by mass.

15. The blast-furnace operating method according to claim 13, wherein a percentage of partially reduced iron having a particle diameter smaller than five millimeters in a whole of the partially reduced iron charged into the blast furnace is equal to or lower than 10% by mass.

16. The blast-furnace operating method according to claim 13, wherein a crushing strength of the partially reduced iron charged into the blast furnace is equal to or higher than 30 kg/cm$^2$.

17. A molten-pig-iron production method comprising producing the molten pig iron by the blast-furnace operating method according to claim 13.

* * * * *